US009357615B2

(12) United States Patent
Van Herpen

(10) Patent No.: US 9,357,615 B2
(45) Date of Patent: May 31, 2016

(54) METHOD FOR GUIDING A HUMAN TO A REFERENCE LOCATION, AND LIGHTING SYSTEM COMPRISING A PLURALITY OF LIGHT SOURCES FOR USE IN SUCH METHOD

(75) Inventor: Maarten Marinus Johannes Wilhelmus Van Herpen, Heesch (NL)

(73) Assignee: Koninklijke Philips N.V., Eindhoven (NL)

( * ) Notice: Subject to any disclaimer, the term of this patent is extended or adjusted under 35 U.S.C. 154(b) by 344 days.

(21) Appl. No.: 14/129,366

(22) PCT Filed: Jun. 15, 2012

(86) PCT No.: PCT/IB2012/053017

§ 371 (c)(1),
(2), (4) Date: Dec. 26, 2013

(87) PCT Pub. No.: WO2013/005122

PCT Pub. Date: Jan. 10, 2013

(65) Prior Publication Data

US 2014/0132183 A1 May 15, 2014

(30) Foreign Application Priority Data

Jul. 1, 2011 (EP) ..... 11172379

(51) Int. Cl.

| | |
|---|---|
| ***G08B 3/00*** | (2006.01) |
| ***H05B 37/02*** | (2006.01) |
| ***G08B 7/06*** | (2006.01) |
| ***F21S 9/02*** | (2006.01) |
| ***F21V 23/00*** | (2015.01) |

(52) U.S. Cl.

CPC ..... *H05B 37/02* (2013.01); *F21S 9/022* (2013.01); *F21V 23/008* (2013.01); *G08B 7/066* (2013.01)

(58) Field of Classification Search

USPC ..... 340/328, 628

See application file for complete search history.

(56) References Cited

U.S. PATENT DOCUMENTS

| | | | | |
|---|---|---|---|---|
| 6,150,943 | A * | 11/2000 | Lehman | G08B 7/066 340/332 |
| 6,646,545 | B2 * | 11/2003 | Bligh | G08B 7/062 340/286.05 |
| 7,026,947 | B2 * | 4/2006 | Faltesek | G08B 27/001 340/511 |
| 7,800,511 | B1 * | 9/2010 | Hutchison | G08B 7/066 340/3.1 |
| 8,077,017 | B2 * | 12/2011 | Kennedy | G08B 7/062 340/328 |
| 8,083,367 | B2 * | 12/2011 | Anderson | F21S 4/007 315/312 |
| 8,142,061 | B2 * | 3/2012 | Jablonski | A43B 1/0036 362/559 |
| 8,297,789 | B2 * | 10/2012 | Liu | G09F 13/04 362/249.02 |

(Continued)

FOREIGN PATENT DOCUMENTS

| | | |
|---|---|---|
| DE | 4002095 A1 | 8/1991 |
| GB | 2466656 A | 7/2010 |

(Continued)

*Primary Examiner* — Adam Houston

(57) ABSTRACT

The invention provides a method for intuitively guiding a human to a reference location, such as an emergency exit, with a lighting system comprising a plurality of light sources along a pathway to the reference location. The lights shine with an intensity dependent upon the distance to the reference location, in particular the intensity of the light increases with decreasing distance to the reference location. The location of the emergency can be determined through emergency sensors, so that the intensity of the light sources is then controlled to lead away from the danger to the nearest safe exit.

7 Claims, 2 Drawing Sheets

(56) References Cited

U.S. PATENT DOCUMENTS

| | | | | |
|---|---|---|---|---|
| 8,443,535 | B2 * | 5/2013 | Liu | F21S 9/022 40/546 |
| 8,475,024 | B2 * | 7/2013 | Stokes | A62B 3/00 362/34 |
| 8,878,666 | B2 * | 11/2014 | Chu | G01S 5/0231 340/500 |
| 8,884,772 | B1 * | 11/2014 | Zhang | G08B 7/066 340/506 |
| 8,896,427 | B1 * | 11/2014 | Ramirez | G08B 7/062 340/286.05 |
| 9,142,103 | B2 * | 9/2015 | Robotham | G08B 5/38 |
| 9,237,634 | B2 * | 1/2016 | Knibbe | G08B 7/066 |
| 2006/0067295 | A1 | 3/2006 | Lehotsky | |
| 2006/0071802 | A1 * | 4/2006 | Right | G08B 3/10 340/628 |

FOREIGN PATENT DOCUMENTS

| | | | |
|---|---|---|---|
| WO | 2005116519 | A1 | 12/2005 |
| WO | 2006095317 | A1 | 9/2006 |
| WO | 2009153393 | A1 | 12/2009 |
| WO | 2010052606 | A2 | 5/2010 |
| WO | 2012069782 | A1 | 5/2012 |

* cited by examiner

METHOD FOR GUIDING A HUMAN TO A REFERENCE LOCATION, AND LIGHTING SYSTEM COMPRISING A PLURALITY OF LIGHT SOURCES FOR USE IN SUCH METHOD

FIELD OF THE INVENTION

The invention relates to a method for guiding a human to a reference location and to a lighting system comprising a plurality of light sources, for instance for use in such method. The invention further relates to a space including such lighting system, as well as to a computer program to enable a processor to carry out the method of the invention.

BACKGROUND OF THE INVENTION

A problem in emergency situations may be that people do not always behave in a controlled way, and they do not follow the predetermined escape routes. There can be many reasons for this. People do not necessarily observe the possible emergency escape routes and/or the markings pointing to said routes. Moreover, in emergency situations people tend to use routes that they are already familiar with.

Method and systems to guide evacuees out of a building are known in the art. There are various systems for guiding people in hazardous situations, for instance in case of fire, to the emergency escape routes of buildings or vessels. Among these systems, also systems are known with illumination arrangements of emergency escape routes, or emergency escape routes that are marked in some other way, for example by reflective paint or tape.

WO 09/153393, for instance, describes a method for controlling guiding, signal or alert lights, particularly signal lights, for an emergency escape route in a fire situation, in which method there are controlled sequentially arranged light sources, such as LED light sources. In the method, in the first step the sequentially arranged light sources, which are most advantageously arranged as a light source string or at least as part thereof, are activated, on the basis of a signal received from a fire detector, to be switched to a first mode, in which first mode the sequentially arranged light sources are used for indicating the direction of an escape route, and/or to a second mode, where the light sources are switched to emit continuous light. WO 09/153393 also relates to a system and a device.

SUMMARY OF THE INVENTION

Therefore, a problem is how to guide people out of a space, such as building, during an evacuation. More specifically, the problem is how to guide them during a power failure, or when there is limited visibility or panic. It is important that people take a route towards the closest exit, but, as mentioned above, in general people may tend to follow the known route they used when entering the building. Another problem is how to guide humans under panic or extreme stress situations, which can cause a changing behavior of humans.

Hence, it is an aspect of the invention to provide an alternative method for guiding a human to a reference location, such as an emergency exit, and an alternative lighting system comprising a plurality of light sources, for instance for use in such method, which method and lighting system preferably further at least solve one or more of above-described problems.

The solution proposed here is to increase the egress path (way) illumination in the direction of the nearest safe exit. Because people instinctively tend to flee towards the light, they will instinctively take the route towards the closest safe exit. In this way, instinctively human (but also animals) may choose the desired direction, without the need of thinking.

In prior art solutions, there may still be one or more moments where people have to decide (i.e. cognitively instead of intuitively/instinctively) which direction to go. For instance, lights that are flashing in a dynamic mode (in a predetermined direction), as known from the prior art, may be confusing because it may be unclear whether the direction should be followed or not, or there may be confusing or contra-intuitive messages given by the lights. For example, when a human is located somewhere between the array of sequentially arranged sources, at one moment a light at a certain position may be flashing (indicating to go that direction), whereas at a later moment, another light at another position may be flashing (indicating to go another direction than the previous direction). In such dynamic mode, the desired direction can only be understood when information is collected over some time and interpreted. The present solution however, may advantageously guide humans (and animals) to an emergency exit in an intuitive way.

Hence, in a first aspect, the invention provides a method for intuitively guiding a human to a reference location, such as an emergency exit, with a lighting system, wherein the lighting system comprises a plurality of light sources, by providing with the light sources along a pathway to the reference location light with an intensity dependent upon the distance to the reference location, wherein the intensity of the light increases with decreasing distance to the reference location. The increase in intensity may for instance be linear (such as for instance intensity ratios of 20:40:60:80:100) or non-linear.

With such method, a human in an emergency situation, looking for a way away from the emergency and/or for a safe place or exit may intuitively follow a route to the brightest place. Hence, in a substantially non-cognitive way a human may find his or her way to the reference location. This effect can be obtained with the emergency lighting function of the light sources. This emergency lighting function may in an embodiment be used in case of an emergency, in an embodiment in case of a (general) power failure, but optionally in other embodiments also for other purposes.

The invention may in an embodiment also be applied in non-emergency situations.

In the method a "static" lighting system or a "dynamic" lighting system, or a plurality of two or more of such systems, may be applied.

With the former term, it is indicated that the individual light sources have a predefined, in an embodiment even not variable, intensity. Different light sources may however be configured to generate light with different intensities.

This may be the case when (in a variant) the light sources have been produced to generate light with different intensities.

However, this may also be the case (in a further variant) where the light sources have variable intensities, but (before arrangement in a space) are set at a specific (predetermined) intensity. In such variant, according to a plan, the light sources may be arranged along a pathway to the reference point, with the light source(s) having strongest intensity close to the reference point and with the light sources with the lowest intensity farthest away from the reference point. Hence, in this variant, the light sources may be configured to generate light with a variable light intensity, but when arranged on location and in use in the method of the invention, the intensity is not variable (but for instance set according to said plan). The phrase "light source(s) having variable intensities" and similar phrases indicate that the light source(s) are configured to provide light with at least two different intensities, preferably at least three different intensities, more preferably at least five different intensities.

In this way, light sources along the pathway to the reference location provide light with an intensity increasing with decreasing distance to the reference location. The use of such system may include embodiments wherein the plurality of light sources only show the behavior of the intensity increase with decreasing distance to the reference location when there is an emergency situation (see further also below).

With the latter term ("dynamic" lighting system), it is indicated that the light sources have a variable intensity, i.e. in an embodiment each light source may be configured to generate light with a variable light intensity, and may be addressed independently to set the desired intensity (for instance in case of an emergency). In such embodiment, the lighting system may further comprise a control unit, configured to control the light intensity of the individual light sources as function of the distance of the individual light sources to the reference location. This opens options to control the intensity of the light sources not only as function of the distance to the reference point, but also as function of location of emergency. Optionally, the reference point may change in time, for instance when the location of emergency changes (including extends). The location of emergency may, as indicated, change, for instance due to extension of emergence. Hence, the control unit may control the intensity of the light of a specific light source in time, dependent upon the desired reference location (which may depend in time) and optionally the location of emergency. Also, the location of emergency is likely to be different for different emergency events.

Whereas in static systems the light sources might in some occasions guide in the wrong direction (just like static exit signs can sometimes guide people towards an unsafe place), when the method of the invention includes controlling the intensity of the light sources as function of the location of an emergency, the shortest and safest pathway to the reference point may always be shown. Hence, the method of the invention may further comprise defining, in case of an emergency, a location of emergency and further controlling the light intensity of the individual light sources as function of the distance to the location of emergency. The information about the location of an emergency may for instance be derived from a sensor, herein also indicated as emergency sensor (see also below).

The lighting system may comprise other types of light sources, or the space wherein the lighting system is used may comprise other types of light sources, independent of the lighting system. The control unit of the lighting system may however also be configured to control those other (type of) light sources. Especially in case of an emergency, when humans may have to be guided to the reference location, it may be desired that light of other light sources than those used to guide humans to the reference location is reduced in intensity, including in an embodiment be switched off. Hence, the method of the invention may further comprise, in case of an emergency, reducing light of other light sources than those used for said providing with the light sources along the pathway to the reference location light with an intensity dependent upon the distance to the reference location. As indicated above, the term "reducing" may in an embodiment also include switching off.

In addition to the other type of light sources or alternative thereto, one or more of the light sources of the lighting system may in an embodiment be configured to have different functionalities. For instance, a light source may be used for one or more of general lighting and emergency lighting. Also wall washers, which may under normal conditions not be used as emergency lighting, may in the invention in case of an emergency used to provide light along the pathway to the reference location with increasing intensity. It may however well be that in case of an emergency, the other functionality or functionalities are suppressed or reduced. Hence, in an embodiment wherein one or more of the light sources have an emergency lighting function and a second lighting function, the control unit may be configured to control the lighting function of the light sources (and choose the desired function dependent upon the conditions such as normal and emergency).

The term "reference location" may in an embodiment also refer to a plurality of reference locations. As indicated above, the reference location may comprise an emergency exit. In an embodiment, there may be a plurality of emergency exits. As is known in the art, normal entrances/exits may also have the function of an emergency exit.

In a further embodiment, loss of power may trigger switching on of the light sources or change the function of the light sources to the emergency function.

Having described above embodiments of the method of the invention, now embodiments of the lighting systems are described in more detail.

In an aspect of the invention, a lighting system ("emergency lighting system") is provided, wherein the lighting system comprises a plurality of light sources, wherein each light source is configured to generate light with a different intensity. Especially, the invention provides a lighting system, wherein the plurality of light sources are configured to provide with the light sources along a pathway to the reference location (such as an emergency exit) light with an intensity dependent upon the distance to the reference location, wherein the intensity of the light increases with decreasing distance to the reference location.

Even more especially, each light source may be configured to provide light with a variable light intensity.

In yet a further embodiment, the lighting system further comprises a control unit. The control unit may especially be configured to control the light intensity of the individual light sources as function of a distance of the individual light sources to a reference location. The term "control unit" may include a plurality of non-interrelated or (preferably) interrelated control units.

Hence, in a specific embodiment, the invention provides a lighting system comprising (i) a plurality of light sources, wherein each light source is configured to generate light with a variable light intensity, and (ii) a control unit, configured to control the light intensity of the individual light sources as function of a distance of the individual light sources to a reference location. Advantageously, with such lighting system, humans (and animals) may be guided in an intuitive way to a reference location, such as an emergency exit. This may especially be a safe solution when the lighting system is used as emergency lighting system (in cases of emergency), since humans may intuitively find their way to the location with the most light as this appears to be normal human behavior in cases of emergency.

The lighting system may be used for (embodiments of) the method of the invention, as defined above. Hence, the invention thus also includes a method, wherein the lighting system—as defined herein—is applied for intuitively guiding a human to the reference location by controlling the intensity of the light of the plurality of light sources as function of the distance of the individual light sources to the reference location, wherein the intensity of the light increases with decreasing distance.

Herein, the term "plurality of light sources" may also refer to a plurality of subsets of light sources, wherein each subset comprises one or more light sources, wherein the light sources within a subset are configured to generate light with substantially the same (predetermined) intensity, and wherein the light sources from different subsets differ in (predetermined) intensity. For instance, the lighting system may comprise four subsets of, for instance, each five light sources. In this way, with 20 light sources four different intensities may be provided. Likewise, the term "each light source" may in an embodiment also refer to each subset of light sources.

As indicated above, the control unit may further be configured to control the light intensity of the individual light sources as function of a distance to a location of emergency. In this way, the lighting system may react on the location of the emergency and choose the best distribution of light over the pathway to the reference point, with light sources closer to the location of emergency with a lower light intensity and light sources closer to the reference location with a higher light intensity.

As indicated above, the term "reference location" may also include a plurality of reference locations. Further, the term location of emergency may also include a plurality of such locations. The control unit may especially be configured to determine the best (shortest and safest) way(s) dependent upon the one or more reference points, such as one or more emergency exit(s), and/or optionally the one or more locations of emergency. Therefore, in an embodiment, the control unit may be configured to control the light intensity of the individual light sources as function of the distances of the individual light sources to a plurality of reference locations.

As indicated above, one or more of the light sources may have an emergency lighting function and a second lighting function, especially with the control unit being configured to control the lighting function of the light sources. For instance, the second lighting function may be a general lighting function. In case of emergency or power failure, the general lighting function may be switched off by the control unit and the emergency lighting function is applied.

Systems are known in the art, wherein the second lighting function is the normal lighting function, and in cases of emergency or power failure, the normal light function is switched off and the same light source is used for emergency lighting. For instance, fluorescent lamp systems may be equipped with (further electronics), including a battery and a dedicated ballast, to use the fluorescent lamp as emergency lighting, powered by the battery and driven with the dedicated (for example low power) ballast. Likewise this may apply to other types of (general lighting) light sources, such as LED based light sources. Hence, the lighting system, especially each light source, may be equipped with electronics equipment that transforms LED or fluorescent fixtures into code-compliant emergency lighting sources. Further, the lighting system, one or more subset of light sources thereof, or each individual light source, may further include or be connected to a battery/batteries, which in case of emergency provide power.

To interactively define the pathway to the reference location in case of an emergency, the lighting system may further comprise one or more sensors that may be used to detect an emergency. Hence, the lighting system may further comprising an emergency sensor configured to generate an emergency sensor signal, and the control unit may further be configured to control the light intensity of the individual light sources as function of the emergency sensor signal. In case predefined "emergency" conditions, this may define an emergency situation or power failure, which triggers use of the emergency lighting for guiding humans to the reference point.

In an embodiment, the emergency sensor may comprise one or more sensors selected from the group consisting of a smoke sensor, a temperature sensor, a sound sensor, a gas sensor, a water sensor, and a radioactivity sensor. Especially, the emergency sensor may comprise one or more sensors selected from the group consisting of smoke sensor, a temperature sensor, and a gas sensor.

Alternatively or additionally, the lighting system may further comprise one or more camera's (herein also indicated as sensor(s)). The control unit may be configured to derive from the images from the camera information on the presence or potential presence of an emergency situation. For instance, the control unit may be configured to apply image recognition software to the image(s) of the camera(s).

The term "sensor" may also refer to a plurality of sensors. The control unit may be configured to derive from the sensor signal whether there is an emergency and determine the location of the emergency. Of course alternatively and/or additionally, the location of emergency may be defined manually (for instance via a user input device or interface).

In a further embodiment, the lighting system is configured to switch on the light sources or change the function of the light source to the emergency function when a loss of power is detected. The individual light sources, a subset of light sources or the entire lighting system may work on battery power (in case of emergency). Hence, the lighting system may further comprise an emergency power supply, such as a battery.

In yet a further aspect, the invention provides a space comprising the lighting system as defined herein. The space may be (part of) a hospitality area, such as a restaurant, a hotel, a clinic, or a hospital, an office, a department store, a warehouse, a cinema, a church, a theatre, etc. However, the space may also be a plant or a school. The space may be an indoor area, but may in an embodiment also be an outdoor area, such as a plant (outdoor part), a park, an amusement park, etc.

In a basic embodiment the invention provides a building comprising emergency lighting units along an egress path, wherein the lighting units supply an amount of lighting such that a minimum illumination along the entire egress path (way) is achieved and the illumination varies along the egress path, such that people will find the way towards the closest exit by following the egress path(way) in the direction of higher illumination. In a further embodiment the egress pathway illumination can be changed dynamically, depending on the location of a hazard, such as for example a fire.

In a further aspect, the invention provides a computer program configured to enable a processor to carry out the method as defined above. The invention further provides a record carrier storing such computer program.

The term "substantially" herein, will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a system or device comprising one or more of the characterizing features described in the description and/or shown in the attached drawings.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale.

DETAILED DESCRIPTION OF THE EMBODIMENTS

Figure 1A:
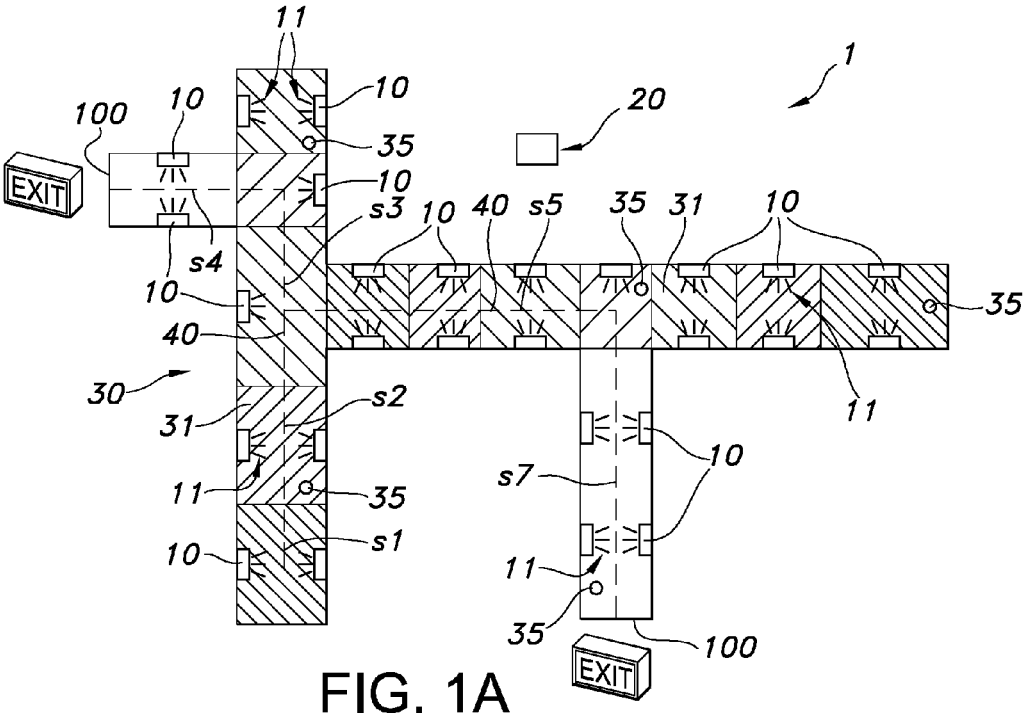
FIGS. 1*a*-1*c* schematically depict embodiment of a space wherein the method of the invention is applied.
Figure 1B:
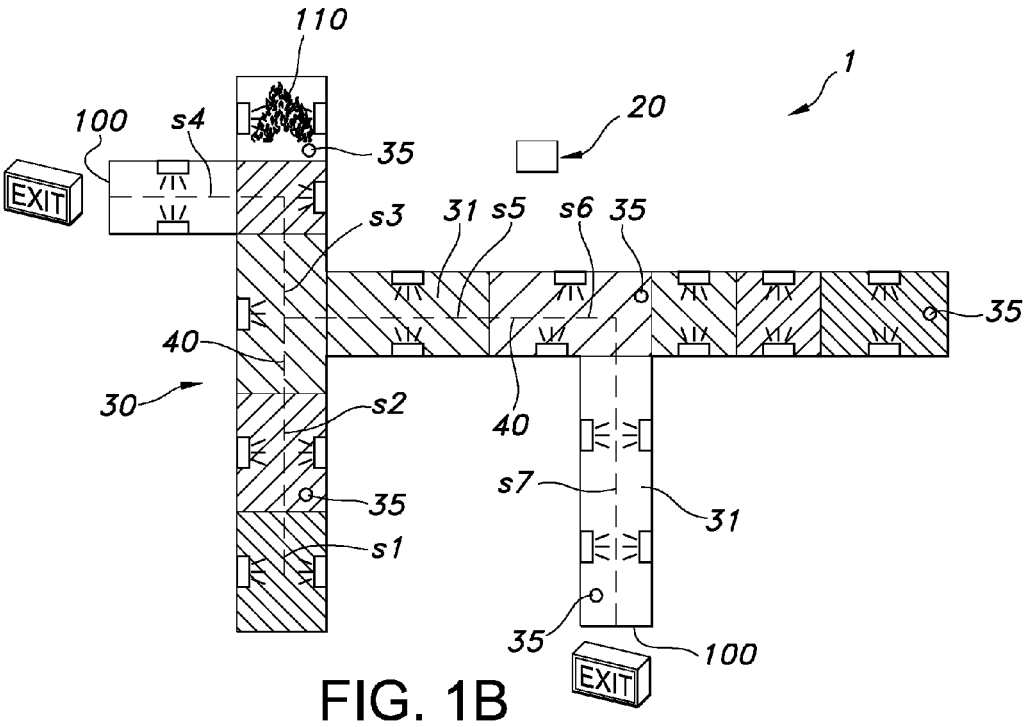
Figure 1C:
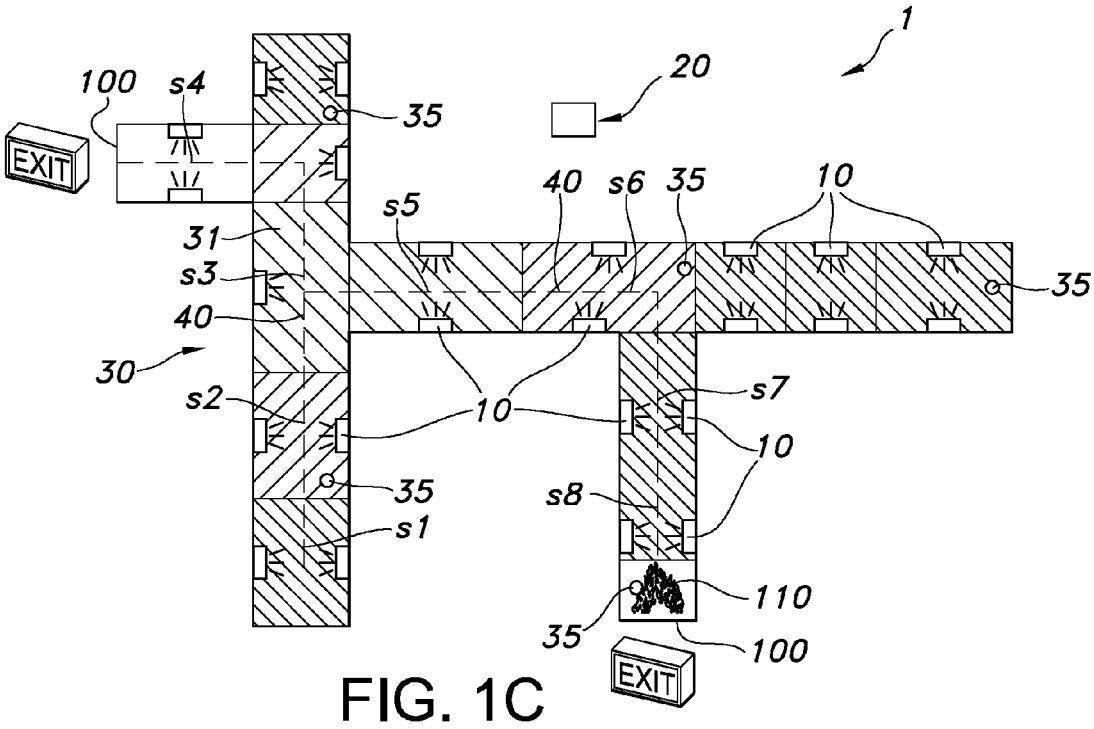

FIGS. 1*a*-1*c* schematically depict a space 30 comprising a lighting system 1. The space may for instance comprise a hallway in a hotel with adjacent rooms (not depicted) or a hallway in a school with adjacent class rooms (not depicted). Only the hallway is schematically depicted. The hallway is indicated with reference 31. Through this hallway 31 a human may find his or her way to a reference point 100, such as an exit, especially an emergency exit. In the schematic drawings, two reference points 100, here two (emergency) exits are depicted.

The space comprises a plurality of light sources 10. These light sources 10 may be arranged at the walls and/or the ceilings and/or in the floors, respectively. The light sources 10 may be embedded in the walls and/or the ceilings and/or the floors, respectively, but one or more light sources 10 may also be arranged as standing lamps or as hanging lamps. The arrangement of the light sources is in general not relevant. The light sources 10 provide light 11.

Referring to FIG. 1, assuming a person starting at position s1, one of the reference points 100 can be reached via the pathway s1-s2-s3-s4. The other reference point 100 can be reached via pathway s1-s2-s3-s5, etc. Those routes are indicated with pathway(s) 40. In case of an emergency, it is desired that evacuees choose the shortest pathway 40, i.e. s1-s2-s3-s4. A person at s1 will intuitively go the direction of where there is more light. This is indicated with the dark areas which become brighter and brighter in the direction of the reference point 100. Having reached point s3, there can be chosen between straight on in the direction of s4 or to the right in the direction of s5. Since in the direction of s4 more light 11 is perceived (lighter area) than to the right, the person will intuitively choose straight on, instead of the longer route to the right.

The combination of all light sources 10 that are used to guide for intuitively guiding a human to the reference location 100 is indicated with lighting system 1. The light sources 10 may have a predetermined and fixed light intensity, and may optionally be switched on/or receive the above functionality only in case of an emergency.

Optionally, the lighting system 1 may further comprise a control unit 20. This control unit 20 may in an embodiment be configured to switch on the light sources 10 or dedicate the light sources 10 to the above functionality in case of an emergency. The lighting system 1 may further comprises one or more sensors 35. Those sensor(s) 35 may be used as emergency sensors. For instance, one or more smoke sensors and/or one or more gas sensors may be applied as sensor(s) 35.

FIG. 1*a* schematically depicts an embodiment of the space 30 comprising emergency lighting units (light sources 10) along an egress path (pathway 40), wherein the lighting units supply an amount of lighting such that a minimum illumination along the entire egress pathway is achieved and the illumination varies along the egress path, such that people will find the way towards the closest exit by following the egress pathway in the direction of higher illumination. The depicted lighting system 1 may be "static" in the sense that the light intensities may not be adaptable as function of a location of emergency. Would the light sources 10 allow variable light intensity, then the control unit 20 may control the light intensity of the individual light sources 10 as function of a distance of the individual light sources 10 to the reference location 100.

FIGS. 1*b* and 1*c* schematically depict situations wherein there is a case of emergency, such as a fire. The location of emergency is indicated with reference 110. Here a dynamic system is applied, i.e. the lighting system 1 knows (has detected or has been informed) about the location of emergency 110. Further, light sources 10 are applied that have the ability to provide light with variable light intensities.

Now, the control unit 20 can control the light intensity of the individual light sources 10 as function of a distance of the individual light sources 10 to the reference location(s) 100 but also as function of the distance to the location of emergency 110.

In FIG. 1*b*, with the location of emergency 110 at above defined pathway s1-s2-s3-s4, the human should not follow this pathway, but decide at s3 to go right instead of straight on. The light intensities of the light 11 of the light sources 10 is controlled in such a way, that at the point s3, the human will decide to go right, because in that direction more light is perceived.

In FIG. 1*c* the location of emergency 110 is somewhere else. Now for a human at s1, the pathway 40 s1-s2-s3-s4 is the shortest one. The light intensity is controlled in such a way, that the human is guided intuitively to the reference point 110 above right. A human at s7 or s6 however, will not be guided to the reference point 100 right below, because there is a location of emergency 110, and the light source provide light intensity in such a way, that the pathway s6-s5-s3-s4 is intuitively chosen.

Figure 2A:
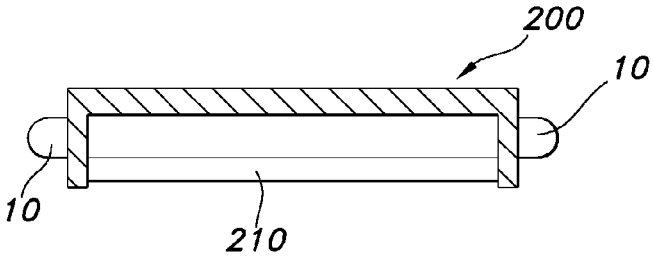
FIGS. 2*a*-2*b* schematically depict some embodiments of specific light sources that can be used in the invention.
Figure 2B:
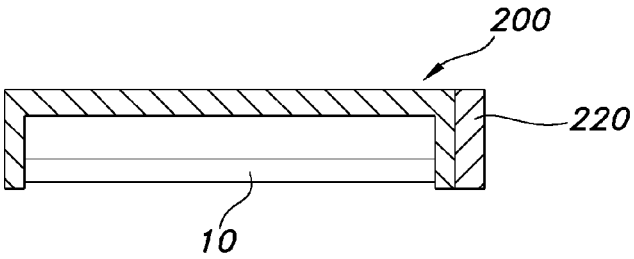

Any type of light source may be used in the lighting system 1 of the invention. FIGS. 2*a* and 2*b* schematically depict non-limitingly some embodiments. FIG. 2*a* schematically depicts a conventional lighting unit 200, with a second light source 210, such as a fluorescent lamp, accompanied by light sources 10. In case of an emergency, the light intensity of the second light source 210 may be reduced (including optionally switched off), and the light sources 10 may be switched on, remain intensity or increase or decrease intensity, dependent upon the location of such light source 10 and the functionality of such light sources (variable intensity or not). FIG. 2*b* schematically depicts a preferred embodiment of the lighting unit 200, with a conventional light source, that has more than one functionality, but at least the functionality of light source of the lighting systems as defined herein. For instance, a conventional light source may be used, such as a fluorescent lamp or a retrofit LED lamp, with may have for instance the functionality of general lighting, but if decided, this functionally may be switched of and the functionality as light source 10 according to the invention may be selected, such as emergency lighting. To this end, the lighting unit may comprise further electronics 220, such as a battery, a ballast and optionally a remote control unit (to be controlled by the control unit).

As will be clear to a person skilled in the art, in these examples two functionalities are combined in one lighting unit, but these functionalities may also be separated in two different lighting units.

The invention claimed is:

1. A method for intuitively guiding a human to a reference location with a lighting system, wherein the reference location comprises an emergency exit, and wherein the lighting system comprises a plurality of light sources, each having an emergency lighting function and a general lighting function, and wherein the lighting system further comprises a control unit configured to control the light intensity of the individual light sources as function of the distance of the individual light sources to the reference location, by providing with the light sources along a pathway to the reference location light with an intensity dependent upon the distance to the reference location, wherein the intensity of the light increases with decreasing distance to the reference location.

2. The method according to claim 1, wherein each light source is configured to generate light with a variable light intensity.

3. The method according to claim 1, further comprising defining, in case of an emergency, a location of emergency and further controlling the light intensity of the individual light sources as function of the distance to the location of emergency.

4. The method according to claim 3, further comprising, in case of an emergency, reducing light of other light sources than those used for said providing with the light sources along the pathway to the reference location light with an intensity dependent upon the distance to the reference location.

5. A lighting system comprising a plurality of light sources, wherein each light source is configured to generate light with a variable light intensity and wherein each light source has an emergency lighting function and a general lighting function, and a control unit, configured to control the light intensity of the individual light sources as function of a distance of the individual light sources to a reference location comprising an emergency exit such that the light intensity increases with decreasing distance to the reference location.

6. The lighting system 5 according to claim 5, wherein the control unit is further configured to control the light intensity of the individual light sources as function of a distance to a location of emergency.

7. The lighting system according to claim 6, further comprising an emergency sensor configured to generate an emergency sensor signal, wherein the control unit is further configured to control the light intensity of the individual light sources as function of the emergency sensor signal, wherein the emergency sensor comprises one or more sensors selected from the group consisting of a smoke sensor, a temperature sensor, a sound sensor, a gas sensor, a water sensor, and a radioactivity sensor.

* * * * *